US008226311B2

(12) United States Patent
Cronin

(10) Patent No.: US 8,226,311 B2
(45) Date of Patent: Jul. 24, 2012

(54) SINGLE-USE COSMETICS APPLICATOR

(76) Inventor: Lisa W Cronin, San Marcos, CA (US)

( * ) Notice: Subject to any disclaimer, the term of this patent is extended or adjusted under 35 U.S.C. 154(b) by 0 days.

(21) Appl. No.: 12/464,862

(22) Filed: May 12, 2009

(65) Prior Publication Data

US 2011/0103880 A1 May 5, 2011

(51) Int. Cl.
*A45D 40/20* (2006.01)

(52) U.S. Cl. ..... 401/98; 401/88; 401/262

(58) Field of Classification Search ..... 401/88, 401/262, 98
See application file for complete search history.

(56) References Cited

U.S. PATENT DOCUMENTS

| | | | | | |
|---|---|---|---|---|---|
| 59,219 | A | * | 10/1866 | Heisterman | 12/54.1 |
| 4,915,234 | A | * | 4/1990 | Boeller | 401/89 |
| 5,069,232 | A | * | 12/1991 | Staar | 132/320 |
| 5,221,153 | A | * | 6/1993 | Spatz | 401/98 |
| 5,535,885 | A | * | 7/1996 | Daniel et al. | 206/484 |
| 2004/0209701 | A1 | * | 10/2004 | Finkel | 473/280 |

* cited by examiner

*Primary Examiner* — David J. Walczak
*Assistant Examiner* — Bradley Oliver
(74) *Attorney, Agent, or Firm* — Sandy Lipkin

(57) ABSTRACT

The present invention provides a single-use applicator for spreadable, usually waxy, paste, or crème-type cosmetics compositions. The applicator includes two parts, a generally cylindrical first part having a coating of cosmetic composition at one end, and a generally cylindrical second part which functions as a cover for the cosmetic composition. The cosmetic coated end of the first part slides into an open end of the second part, such that the second part covers and protects the coating. For use, the second part cover can be readily removed and the cosmetic composition applied to the user's lips or other desired location.

2 Claims, 1 Drawing Sheet

FIG. 1
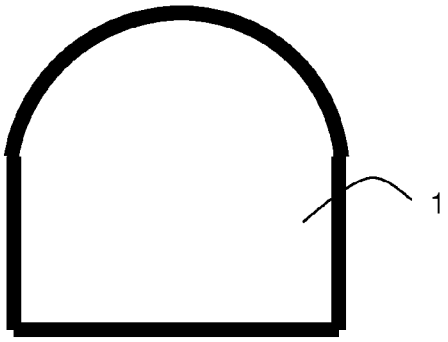
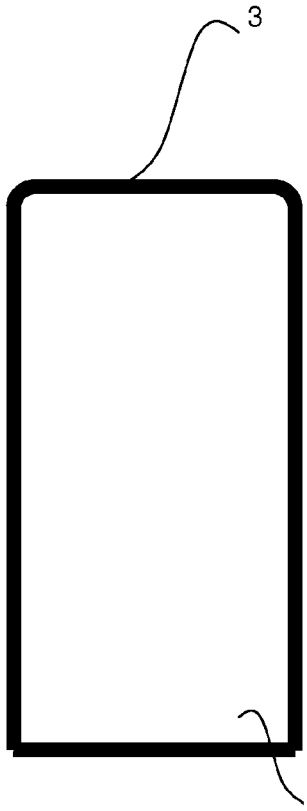
FIG. 2
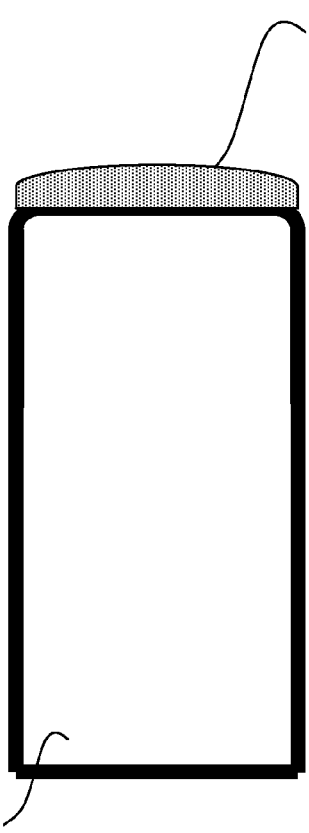
FIG. 3
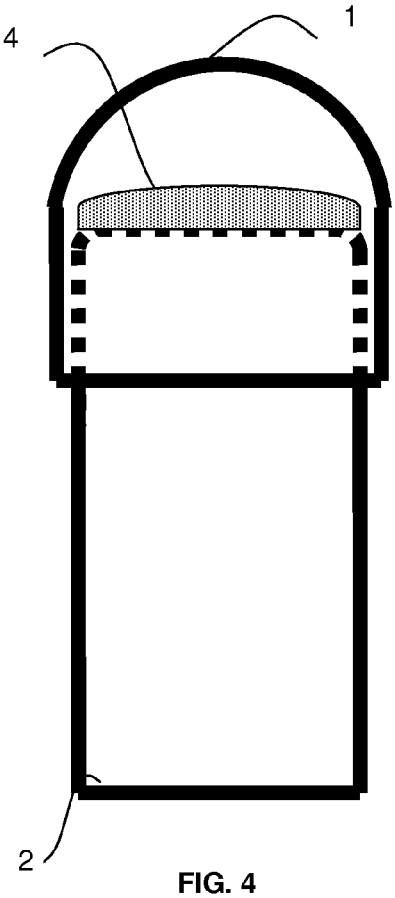
FIG. 4

SINGLE-USE COSMETICS APPLICATOR

RELATED APPLICATIONS

This application claims the benefit of Cronin, U.S. Prov Appl 61/127,256, filed May 12, 2008, which is incorporated herein by reference in its entirety.

FIELD OF THE INVENTION

The present invention relates to the field of biodegradable, sanitary, single-dose, one-use, applicator for cosmetics, such as lipsticks (lip color and lip tints), lip balms, facial make-up such as color base foundation crèmes, blush color crèmes, eye shadow crèmes, etc.

BACKGROUND OF THE INVENTION

The following discussion is provided solely to assist the understanding of the reader, and does not constitute an admission that any of the information discussed or references cited constitute prior art to the present invention.

Cosmetic sampling in over-the-counter stores is very important in the success of final sales. Before purchasing, many women want to see and feel the actual products on their faces to experience the texture, color and etc.

However, conventional cosmetic sampling is very unsanitary and has risks of contamination if using the "open sampling" method. This method is when a sample of the product is taken from an open container by means of a cotton swab, plastic stick, wooden stick, sponge stick, or simply using one's own finger. Some customers double dip into the open container therefore, causing contamination. This method is messy, inconvenient, and not effective.

Apart from the unsightly appearance these samples obtain after multiple uses, there is a great concern about the spread of communicable diseases and viruses. With this concern in mind, there is a need for providing cosmetic companies with a convenient, inexpensive, sanitary, biodegradable, one-dose, single-use, disposable, complete application applicator.

Some cosmetics applicators have been described. Wallschlaeger, U.S. Pat. No. 5,396,913, iss. Mar. 14, 1995 describes a "cosmetic applicator comprising a base support having a substantially nonabsorbent surface, and a coating [consisting] essentially of a composition of lip cosmetic. The composition has an amorphous, noncrystalline structure, and the coating is of a thickness of between 0.5 mils and 5 mils."

Moir, et al., U.S. Pat. No. 4,751,934, iss. Jun. 21, 1988 describes a cosmetic sampler formed by screen printing a slurry of cosmetic powder and solvent onto a paper base.

Bennett, U.S. Pat. No. 5,538,022, iss. Jul. 23, 1996 describes a single-use tester for cosmetic products. The invention is said to provide a disposable applicator for sampling cosmetics including lipsticks at the retail counters, and methods for transferring the cosmetics onto the applicator.

De la Rocha, U.S. Pat. No. 5,020,553, iss. Jun. 4, 1991, describes a lipstick applicator composed of a sheet of paper having a rounded lower edge, and upper edge to be grasped and pair of side edges extending between the upper and lower edges, where a lower zone of the sheet on the opposite main faces is coated with lipstick to be removed by grasping the card between the lips of a user and pulling outwardly.

Smith, U.S. Pat. No. 3,177,879, iss. Apr. 13, 1965 describes a lipstick applicator. The device has a head member having upper and lower peripheral edges of contours corresponding respectively to the longitudinally contracted upper and lower outlines of sections of lips.

Each of the patents cited above is incorporated herein by reference in its entirety.

SUMMARY OF THE INVENTION

During sampling and sharing of certain types of cosmetics, as well as over use of a cosmetic product by a single individual over time, microbial contamination of the cosmetic product and transmission of the contamination can be a significant problem. In addition, in many situations, it is beneficial for a cosmetics user to not need to carry full-size containers of particular cosmetics, e.g., full-size tubes of lipstick. The present invention addresses these concerns by providing sanitary, single-dose, one-use, applicators for waxy, crème, or paste cosmetics such as lipsticks (lip color and lip tints), lip balms, facial make-up such as color base foundation crèmes, blush color crèmes, eye shadow crèmes, etc. In many cases, the applicators are biodegradable.

Thus, in a first aspect, the invention concerns a single-use cosmetics applicator which includes a two-part closable body. The body includes a first part (as base or base support) and a second part (a cover), where the first part includes a body sealingly and removably matching the second part. The second part fits over and covers one end of the first part, with a small gap between the covered end of the first part and the interior surface of the second part (often, for example, a gap of about 0.1 to 2 mm, although gaps outside that range may also be useful). The covered portion of the first part includes a coating surface on which a crème or paste type cosmetic composition is coated. Preferably the coating surface is substantially non-absorbent.

In advantageous embodiment, the first part is a generally cylindrical tube with a closed end forming a terminal surface and the other end may be open or closed, and the second part is a generally cylindrical tube with a closed end and an open end and an interior surface and an exterior surface. The first part and said second part are sized and configured such that the closed end of the first part removably slides into the open end of the second part leaving a gap between the terminal surface of the first part and the interior surface of the closed end of the second part. The terminal surface of the first part bears a coating of a single-use quantity of a spreadable (e.g., waxy, paste, or crème) cosmetic composition.

In certain embodiments, the first and/or second parts of the body are formed of biodegradable material; the body (or a part thereof) is formed of gelatin or hypromellose; the body (or part thereof) is formed of a biodegradable plastic (preferably fully biodegradable); the body (or at least the second part) is substantially clear; the terminal surface of the first part is modified to improve retention of the cosmetic composition; the terminal surface is modified by chemical etching, mechanical abrasion (e.g., sanding, grinding, particle blasting), and/or crinkling; the terminal surface is substantially hemispherical; the terminal surface is or includes a flattened surface.

In particular embodiments, the cosmetic composition is lipstick, lip balm, foundation crème, crème blusher, or crème eye shadow.

In certain embodiments, a plurality of the applicators are provided within a dispensing container, e.g., at least 10, 50, 100, 200, 500, or 1000; a plurality of the applicators are provided within a dispensing container which dispenses the applicators one at a time, e.g., a gravity feed dispenser.

In a related aspect, the invention also concerns a method for making a single-use cosmetics applicator according to the preceding aspect. The method involves coating the coating surface with a crème or paste type cosmetic composition, and covering coated portion of the first part with the second part (e.g., by sliding the second part over the coated portion of the first part).

In advantageous embodiments, the applicator includes a two-part closable body including a first part and a second part, where the first part is a generally cylindrical tube with a closed end forming a terminal surface, and the second part is a generally cylindrical tube with a closed end and an open end and an interior surface and an exterior surface. The first part and said second part are sized and configured such that the closed end of the first part removably slides into the open end of the second part leaving a gap between the terminal surface and the interior surface of the closed end of the second part. The applicator also has a coating on the terminal surface of a single-use quantity of a spreadable cosmetic composition. The method involves coating the terminal surface with the cosmetic composition and sliding the first portion into said open end of the second portion.

In particular embodiments, the coating is performed by dipping the terminal surface of the first part into a quantity of fluid cosmetic composition (e.g., composition made fluid by heating and/or by mixing). In certain embodiments where the coating is applied by dipping, during the dipping the first part is pressed against a solid surface with sufficient pressure to crinkle the terminal surface (highly preferably without damaging other portions of the first part in a manner which prevents or makes it difficult to slip the first part into the second part (or conversely to slip the second part over the first part; the solid surface may be heated to assist in deforming the terminal surface without deformation transfer to other portions of the part).

The invention also concerns a method for sampling a cosmetics composition, by providing at least one single-use cosmetics applicator as described for the first aspect above (or otherwise described herein for the present invention) to a potential customer, where the cosmetic composition in the applicator is a cosmetic composition to be sampled.

In particular embodiments, the sampling is conducted in a retail store, the applicators are provided by a retail store or by a cosmetics manufacturer or distributor.

The invention also concerns a method for applying a paste or crème type cosmetic by using a single-use cosmetics applicator as described for the first aspect above (or otherwise described herein for the present invention) to apply the included cosmetic composition to the lips or other skin surface of an individual (e.g., of the user).

Typically using the applicator involves removing the cover and spreading the cosmetic composition onto the individual's lip(s) or other desired skin surface.

As used herein in connection with cosmetic compositions, the term "spreadable" means that in the quantities and thicknesses normally used for the invention, the composition is a non-running composition which can be spread out over a skin area with only moderate pressure. Such spreadable compositions may, for example, be wax-based, crème, or paste type compositions. Common examples include lipsticks and lip balms conventionally supplied in tube form.

As used herein (e.g., in connection with applicator covers), the term "clear" means substantially transparent and not colored. Thus, for example, the color of a cosmetic coating can be seen with reasonable accuracy through a clear cover.

Additional embodiments will be apparent from the Detailed Description and from the claims.

BRIEF DESCRIPTION OF THE DRAWINGS

FIG. 1 illustrates the top cover of an empty hard gelatin capsule depicting the cover (1) of an exemplary applicator.

FIG. 2 schematically illustrates the body of an exemplary applicator showing an empty hard gelatin capsule base support.

FIG. 3 schematically illustrates the applicator body of FIG. 2 with the cosmetic composition coating.

FIG. 4 schematically illustrates a complete cosmetics applicator with the cover in place on the base support.

DETAILED DESCRIPTION OF THE PREFERRED EMBODIMENTS

The present invention concerns a cosmetic sampler or applicator for single-use application of crème or paste cosmetic compositions. The applicator includes a body or base support (preferably biodegradable) having a non-slick or non-slippery surface in a coating area; a coating of a cosmetic composition deposited on the coating area of the base support; a cover (preferably biodegradable) for covering and protecting the coating. With the covering in place on the base support, the cover is spaced apart from the coating.

Base and Cover

The base and the cover are made from materials which provide sufficient strength for the application at low cost. Sufficient strength can be determined for a particular material and configuration combination based on whether the applicator has sufficient strength and rigidity to resist collapse or other excessive deformation while enabling a user to ready remove the applicator cover by hand, and to hold the applicator base support and apply the cosmetic coating applied to the their lips or other intended body surface. One advantageous material for the cover and/or base support is gelatin. Among it many uses, gelatin typically constitutes the shells of pharmaceutical capsules. Hypromellose, the vegetarian counterpart to gelatin, can also be used, but is currently more expensive to produce.

In many cases, the applicator cover and base support will be in the form of hollow cylinders, usually but not necessarily of circular or oval cross-section, with a slip fit between the two portions. In such configurations, the cover will typically have one closed end and one open end, where the open end slips over the cosmetic-coated portion of the base support. For example, when conventional capsules such as those used for pharmaceutical purposes are utilized, the cover will be the larger diameter portion of the capsule, and the cosmetic composition will be coated on the closed end (or one of the closed ends) of the smaller diameter portion of the capsule. Of course, such capsules may be advantageously modified in any of a number of different ways for use in this invention. As an example of such modification, the walls of the capsule (the cover portion or the base support portion or both) may be constructed with thicker walls, thereby providing greater strength. As another example, the base support portion may be constructed with both ends closed, thereby increasing the resistance of the base support to collapse and/or alternatively the base support may be filled with a support material. Yet another example of modification is to change the shape of base support in the area to be coated, e.g., by at least partially flattening the tip of the closed end of a conventional capsule (perpendicular to the central axis of a cylindrical capsule or at a different desired angle.

There are many different sizes of conventional manufactured gelatin capsules; any of a variety of sizes of such manufactured hard gelatin capsules can be used for the present matching base and cover of the applicator. For example, capsules may be used having volumes of about 0.2, 0.3, 0.4, 0.5, 0.6, 0.7, 0.8, 0.8, 0.9, 1.0, 1.1, 1.2, 1.3, 1.4, 1.5, 1.7, 2.0, 3.0, 4.0, or 5.0 ml, or is in a range defined by taking any two of the just specified volumes as included endpoints of the range, e.g., 0.2 to 0.5 ml, 0.5 to 1.0 ml. 0.7 to 1.5 ml. 1.0 to 2.0 ml, or 1.5 to 5 ml.

Further, in addition to the use of conventional gelatin capsules as indicated above, the base support and cover may be manufactured in other shapes besides the typical common cylindrically shaped capsule, for example, square, rectangular, octagonal, oval, elliptical, etc., or representational shapes such as heart-shaped, lip-shaped, and the like. Of course, for any non-standard shapes, molds would have to be made for these different shapes.

In addition to hard gelatin, other materials can be used to form the base support and/or cover, including any of a variety of different plastics. It is recognized most such plastics (e.g., polystyrenes and PVCs) are not biodegradable. However, advantageously, biodegradable plastics could be used, e.g., plastics meeting ASTM D6400-04 Standard Specification for Compostable Plastics. Desirably, a biodegradable plastic is fully biodegradable, and is not merely fragmented into very small particles upon biodegradation. An example of such fully biodegradable plastic is believed to be polyhydroxyalkanoate (PHA) materials.

Construction of Applicator

The cosmetics applicators of the present invention may be manufactured in a variety of different configurations using different materials for the base support and cover and/or for the cosmetic composition. The invention also includes the methods of making or constructing the cosmetics applicator (e.g. as a cosmetic sampler) by coating the coating area of a base support as described above with a single-use amount of a cosmetic composition.

Typically, the cosmetic composition coating in fluid form is applied to the coating surface of the base support, e.g., by dipping the coating surface into a fluid supply of cosmetic composition and then removing the coating surface from the fluid composition. The cosmetic composition will usually be made fluid by heating the composition. Alternatively for some compositions the composition may be made sufficiently fluid by mixing the composition to sufficiently decrease the composition viscosity to form a coating upon the coating surface. These methods can also be combined, e.g., by heating the composition to slightly below its melting point and then mechanically mixing the composition, resulting in a composition at sufficiently low viscosity for proper coating. The viscosity of the composition can be controlled (e.g., by controlling the heating level and/or the type and extent of mixing and/or the type and amount of viscosity modifying materials included in the composition) to result in a composition having suitable viscosity for coating the base support and for application by a user to a skin surface.

The method for making the present applicators can also include preparing the base support by modifying the area where the coating will be deposited, usually to improve adhesion or retention of the cosmetic composition. This alteration can, for example, be accomplished by mechanical techniques (e.g., sanding, grinding, particle blasting, etc.) or by chemical etching (e.g., with an acidic solution) in order to remove the slick slippery surface in at least the coating area of the base support. Alternatively or in addition the coating area can be modified by crinkling, e.g., by partially collapsing a curved end of the base support. The alteration to the said base support is useful in assisting the cosmetic coating to stay properly localized on the base support following deposition of the cosmetic composition on the coating area and during subsequent handling and/or storage.

Exemplary Cosmetics Applicator

An exemplary cosmetics applicator according to the present invention is illustrated schematically in the drawings. FIG. 1 illustrates the top cover (1) of an exemplary cosmetics applicator made from a hard gelatin capsule. FIG. 2 and FIG. 3 illustrate the body or base support (2) of an exemplary cosmetics applicator formed from a hard gelatin capsule. As illustrated, the base support (2) has a smaller diameter than the top cover (1) such that the base support slides inside the top cover with a snug slip fit. In this example, the base support has a modified base area or coating surface (3) on which the cosmetic composition will be deposited. In this example, the base support has a modified structure as compared to conventional capsules by being flattened. Such flattening can be accomplished by molding to the desired shape and/or by collapsing the end of the base support portion after molding to form a flattened area. Such post-molding flattening can create crinkles or folds which help retain the cosmetics coating. The crinkling can be accomplished, for example, by pressing the terminal portion of the base support against a solid surface (which may advantageously be heated) with sufficient pressure to deform the end of the base support).

The coating surface can also be modified to assist in coating adhesion by creating a surface with micropits. Such modification can be done, for example, by sanding, grinding, particle blasting, chemical etching, etc.; the result is to remove the slick slippery surface of the base support (2). The alteration to the base support (2) is useful is helping the cosmetic composition coating (4) stay in place on the base support (2) during handling and storage, and during application to the user's skin surface, e.g., lips. In most cases, the cosmetic composition coating (4) is applied by dipping the coating surface portion (3) of the base support (2) into melted cosmetic composition coating, thereby covering the coating surface area (3). The amount of cosmetic composition covering is highly preferably suitable for a one-dose single-use application.

FIG. 4 schematically illustrates a complete exemplary cosmetics applicator with the cover (1) in place on the base support (2). The coating area (3) of the base support (2) holds the cosmetic coating (4). In this configuration, the cover (1), when in place on the base support (2) covers and protects the cosmetic composition coating (4), with a small gap between the exposed surface of the coating (4) and the inside surface of the cover (1). This complete applicator is readied for use by slipping the cover off of the base support.

Use of the Single-Use Applicator

As described above, this invention concerns a sanitary, one-use, single-dose, disposable applicator for cosmetic facial products such as, lip products (balms, color, tints), crème blushes, crème eye shadows, crème color foundations, etc. Highly preferably, at least the applicator body is biodegradable, resulting in an eco-friendly product. In many cases the applicator is made from an empty hard gelatin capsule (or similar construct) where the dome tip of the smaller diameter body of the capsule is altered by sanding, grinding, etc. to keep the coating of product from slipping off when applied to lips or other skin surface.

To use the applicator, the base is typically held between the forefinger and the thumb with one hand and the cover is held with the forefinger and the thumb of the opposite hand. While holding the two parts, the cover of the hard gelatin capsule is lifted off the base of the hard gelatin capsule. The dome tip of the capsule body with the cosmetic coating can then be contacted to the lips or face in a similar manner to that conventionally used for stick or tube lipstick. After use, place the cover of the capsule back on the capsule body (over the dome tip) and dispose the entire applicator.

Thus, the present applicators essentially solve the problem of spreading bacteria, fungi, and/or viruses (e.g., herpes virus) between individuals in a variety of contexts, as well as reducing the problems associated with growth of bacterial and/or fungi on cosmetics used by a single person over a substantial period of time. For example, most preteen females are guilty of sharing their lip products. They are not educated enough about the hazards, including herpes virus, and thus do not know the potential effects.

As a result, the applicator can be useful in a large number of different situations, including applications relating to both females and males, as well as to individuals from very young ages (e.g., pre-teens or even younger) to adults. In consideration of its most common applications, the present applicator can be referred to as LIP-ITZ™ or LIP-ITZ™ applicator. Thus, for example, the LIP-ITZ™ applicator can be used in:

1. Health Market: (e.g., for lip balm, lip tints, and lip color)

a). Sanitary, disposable, one-time use, single dose applicator.

b). Consumers care about the harsh chemicals in products. LIP-ITZ™ would not need to contain any harsh chemicals or preservatives for killing germs because it is a single dose product.

c). Lip balm "pots" are very susceptible to germs. Most people never wash their hands before dipping their finger into the "pot" of lip product to apply. After they apply it, they usually wipe their finger on their clothing unless they make the effort of getting a tissue or going to the rest room to wash their hands.

d). It is recommended for a makeup product not to be used for more than 3 months. Most people ignore this recommendation. Sharing lip products can cause health problems such as the herpes virus.

2. Dental Market: (lip balm)

Dentists use petroleum jelly and a cotton swab to put on a patient's lips when they get dry from their mouth's being open for a long period of time.

3. Green Market: (e.g., for lip balm, lip tints, lip color)

LIP-ITZ™ are made with empty hard gelatin capsules, therefore they are biodegradable.

4. Resort/Hotel and Day-Spa Market: (e.g., for lip balm)

Hotels, Resorts, and Day Spas could service their customers with LIP-ITZ™ as amenities. Day Spas could, for example, have gallon size containers filled with LIP-ITZ™ in the dressing areas for their male and female customers along with their other amenities.

5. Pharmaceutical Market: (e.g., for lip ointment)

Many lip ointments are applied to the lips using the forefinger. This has the same unsanitary effect as the lip balm "pots". LIP-ITZ™ would be sanitary by applying the single-dose lip ointment to lips and discarding the applicator after use.

6. Sports Market: (e.g., for lip balm, lip tints, or lip color)

Athletes could place a few LIP-ITZ™ in a pill container to bring with them to their sporting events. Also, they would be able to share with other athletes.

7. Sunscreen Market: (e.g., for lip balm, lip tints, or lip color)

LIP-ITZ™ could contain the same ingredients that lip products now use to protect the skin from harmful sun rays.

8. Cosmetic Market: (e.g., for lip tints, or lip color)

a). Cosmetic Companies can give sampler gift packages of their entire lip color line (a different color on each LIP-ITZ™) to their customers.

b). In-store counter sampling. LIP-ITZ™ can be applied directly to the lips for the exact color and look without worrying about germs from others testing product.

c). One Cosmetic Company's own package design with their own logo containing any number amount of LIP-ITZ™ with same lip color can be sold to consumers.

d). There is a waste issue with lip balm sticks and lip stick tubes. These products cannot be applied when the product stick becomes even with the plastic or metal tube holder therefore, there is approximately ½ inch of product waste. The consumer is paying more for the expensive decorated lipstick tubes than the actual lip color product.

e). Each LIP-ITZ™ can be made of clear gelatin for easy viewing of lip color.

f). Companies can use LIP-ITZ™ for "New Lip Color" mail out promotions as samples.

9. Novelty Market: (e.g., for lip balm, lip tints, and/or lip color)

Teens like new unusual products. With LIP-ITZ™, teens can share lip products safely and sanitarily like offering a piece of gum, candy or breath mint to a friend. Different colored LIP-ITZ™ could be used for different flavors of lip balm. (Example: red capsules for strawberry flavor, yellow capsules for pineapple flavor, etc.)

10. LIP BALM COMPANIES: (e.g., lip balm)

Lip balm companies can have a new way of packaging their products other than sticks, tubes, tins, and "pots". Similar to the Cosmetic Companies, they can mail out LIP-ITZ™ as samples to their new and existing customers, for example, if they are promoting a new flavor.

11. RESTAURANTS: (e.g., lip balm)

Restaurants could hand out LIP-ITZ™ in the same manner as mints, candies, toothpicks, etc. to their customers after paying for their meals.

12. ICE SKATING OR ROLLER SKATING RINKS (e.g., for lip balm)

Give to customers when renting skates as an amenity, e.g., using a dispenser.

13. RED CROSS STATIONS (e.g., for lip balm)

Give out to rescued people and sheltered people, e.g., using a dispenser or in packages.

14. HOSPITALS (e.g., for lip balm)

Give to patients using, e.g., using a dispenser. The dispenser can be used at the nurse stations and/or at information desks.

All patents and other references cited in the specification are indicative of the level of skill of those skilled in the art to which the invention pertains, and are incorporated by reference in their entireties, including any tables and figures, to the same extent as if each reference had been incorporated by reference in its entirety individually.

One skilled in the art would readily appreciate that the present invention is well adapted to obtain the ends and advantages mentioned, as well as those inherent therein. The methods, variances, and compositions described herein as presently representative of preferred embodiments are exemplary and are not intended as limitations on the scope of the invention. Changes therein and other uses will occur to those skilled in the art, which are encompassed within the spirit of the invention, are defined by the scope of the claims.

It will be readily apparent to one skilled in the art that varying substitutions and modifications may be made to the invention disclosed herein without departing from the scope and spirit of the invention. Thus, such additional embodiments are within the scope of the present invention and the following claims.

The invention illustratively described herein suitably may be practiced in the absence of any element or elements, limitation or limitations which is not specifically disclosed herein. Thus, for example, in each instance herein any of the terms "comprising", "consisting essentially of" and "consisting of" may be replaced with either of the other two terms. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

In addition, where features or aspects of the invention are described in terms of Markush groups or other grouping of alternatives, those skilled in the art will recognize that the invention is also thereby described in terms of any individual member or subgroup of members of the Markush group or other group.

Also, unless indicated to the contrary, where various numerical values or value range endpoints are provided for embodiments, additional embodiments are described by taking any 2 different values as the endpoints of a range or by taking two different range endpoints from specified ranges as the endpoints of an additional range. Such ranges are also within the scope of the described invention. Further, specification of a numerical range including values greater than one includes specific description of each integer value within that range.

Thus, additional embodiments are within the scope of the invention and within the following claims.

What is claimed is:

1. A single-use cosmetics applicator comprising a two-part closable body comprising a first part and a second part, wherein said first part comprises a generally cylindrical tube with a first closed end forming a terminal surface and a closed second end and said second part comprises a generally cylindrical tube with a closed end and an open end and an interior surface and an exterior surface, and wherein said first part and said second part are sized and configured such that said first closed end of said first part removably slides into the open end of said second part leaving a gap between said terminal surface and the interior surface of the closed end of said second part; and a coating on said terminal surface comprising a single use quantity of a spreadable cosmetic composition wherein said first part and second part are pharmaceutical capsule pieces.

2. A method for making a single-use cosmetics applicator comprising a two-part closable body comprising a first part and a second part, wherein said first part comprises a generally cylindrical tube with a first closed end forming a terminal surface and a second closed end, and said second part comprises a generally cylindrical tube with a closed end and an open end and an interior surface and an exterior surface, and wherein said first part and said second part are sized and configured such that said first closed end of said first part removably slides into the open end of said second part leaving a gap between said terminal surface and the interior surface of the closed end of said second part; and a coating on said terminal surface comprising a single-use quantity of spreadable cosmetic composition; said method comprising:

coating said terminal surface with said cosmetic composition; and sliding said first part into said open end of said second part wherein said first part and second part are pharmaceutical capsule pieces.

* * * * *